US011745534B2

(12) United States Patent
Fukada

(10) Patent No.: US 11,745,534 B2
(45) Date of Patent: Sep. 5, 2023

(54) WRITING UTENSIL AND PRODUCING METHOD OF WRITING UTENSIL

(71) Applicant: ZEBRA CO., LTD., Tokyo (JP)

(72) Inventor: Kohei Fukada, Tokyo (JP)

(73) Assignee: ZEBRA CO., LTD., Tokyo (JP)

( * ) Notice: Subject to any disclaimer, the term of this patent is extended or adjusted under 35 U.S.C. 154(b) by 0 days.

(21) Appl. No.: 17/666,951

(22) Filed: Feb. 8, 2022

(65) Prior Publication Data

US 2022/0281260 A1 Sep. 8, 2022

(30) Foreign Application Priority Data

Mar. 3, 2021 (JP) ..... 2021-033490
Oct. 11, 2021 (JP) ..... 2021-166805

(51) Int. Cl.
*B43K 8/02* (2006.01)
*B43K 15/00* (2006.01)

(52) U.S. Cl.
CPC ..... *B43K 8/028* (2013.01); *B43K 8/024* (2013.01); *B43K 15/00* (2013.01)

(58) Field of Classification Search
CPC ..... B43K 1/12; B43K 8/022; B43K 8/024; B43K 8/028; B43K 8/04; B43K 8/12; B43K 8/08
USPC ..... 401/206
See application file for complete search history.

(56) References Cited

U.S. PATENT DOCUMENTS 3,459,484 A * 8/1969 Abrams ..... B43K 5/1845 401/206
4,166,626 A * 9/1979 Sandor ..... G11B 3/589 401/206
4,997,301 A * 3/1991 Sheu ..... B43K 8/12 401/133
5,971,643 A * 10/1999 Ahmed ..... B43K 27/00 401/44

FOREIGN PATENT DOCUMENTS

JP 7-043846 9/1995

* cited by examiner

*Primary Examiner* — David P Angwin
*Assistant Examiner* — Bradley S Oliver
(74) *Attorney, Agent, or Firm* — Greenblum & Bernstein, P.L.C.

(57) ABSTRACT

To prevent ink from dripping, drying, and the like.

A writing utensil includes: a shaft tube; a writing chip that protrudes more toward the front than the shaft tube so as to discharge ink when pressed against a written face; and an ink supply part that supplies ink to the writing chip from a rear side, wherein the writing chip is at a separate position that is separated toward the front across a space with respect to the ink supply part and is moved due to a predetermined operation to a contact position where the writing chip comes into contact with the ink supply part from a front side.

11 Claims, 3 Drawing Sheets

WRITING UTENSIL AND PRODUCING METHOD OF WRITING UTENSIL

BACKGROUND OF THE INVENTION

Field of the Invention

The present invention relates to a writing utensil that writes when a writing chip on a shaft tube front end side is pressed against a written face and to a producing method of the writing utensil.

Description of the Related Art

For example, as described in Japanese Utility Model Application Laid-open No. H7-43846, writing utensils of this type conventionally include a writing utensil which is equipped with a marker main body, two ink cartridges present inside the marker main body, and a single pen tip part that comes into contact with both tips of the two ink cartridges and the writing utensil mixes inks of two colors in the two ink cartridges and causes a mixed ink to protrude from the single pen tip part.

SUMMARY OF THE INVENTION

According to the conventional art described above, ink may be supplied in excess from the ink cartridges to the pen tip part due to drop impact or the like and may drip from the pen tip part. In addition, when the writing utensil is left in an uncapped state for a long time, both the ink cartridges and the pen tip part may become dry and make the writing utensil unwritable.

In consideration of the problem described above, the present invention is configured as follows.

A writing utensil including: a shaft tube; a writing chip that protrudes more toward the front than the shaft tube so as to discharge ink when the writing chip is pressed against a written face; and an ink supply part that supplies ink to the writing chip from a rear side, and the writing chip is at a separate position separated toward the front across a space with respect to the ink supply part and is moved due to a predetermined operation to a contact position where the writing chip comes into contact with the ink supply part from a front side.

Since the present invention is configured as described above, the present invention is capable of preventing ink from dripping, drying, and the like.

DESCRIPTION OF THE PREFERRED EMBODIMENT

The present embodiment discloses the following features.

Figure 1:
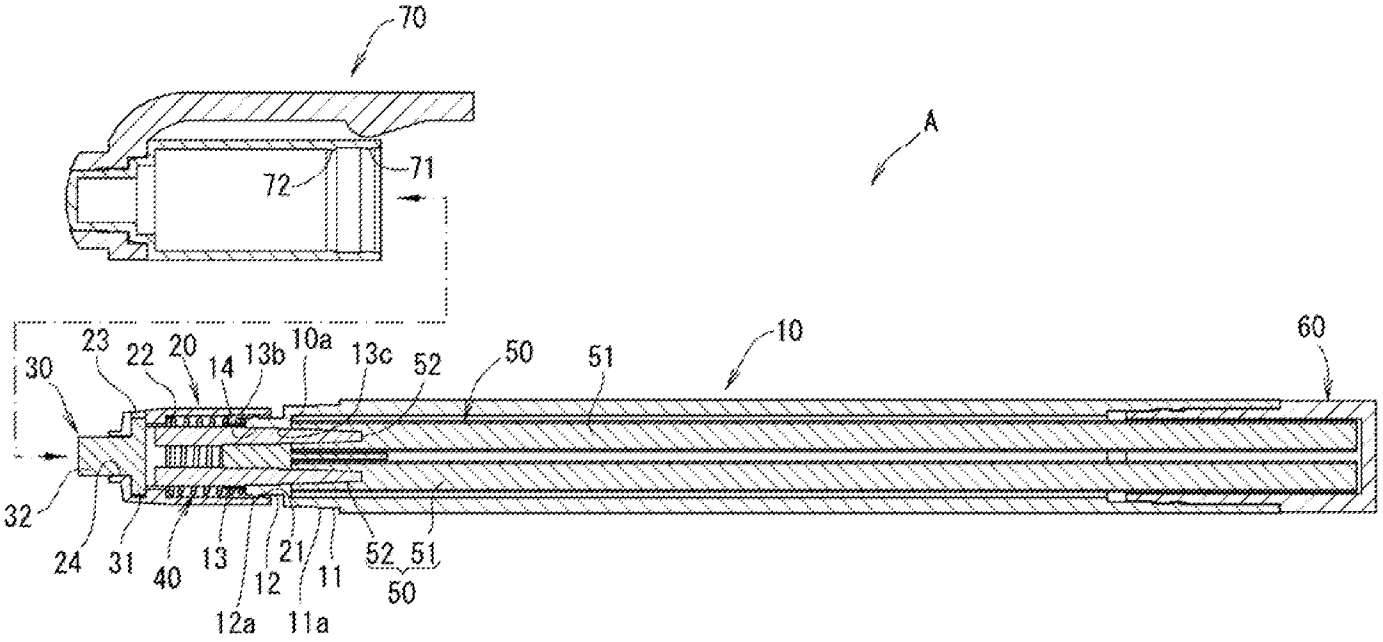
FIG. 1 is a longitudinal section view showing an example of a writing utensil according to the present invention.
Figure 2:
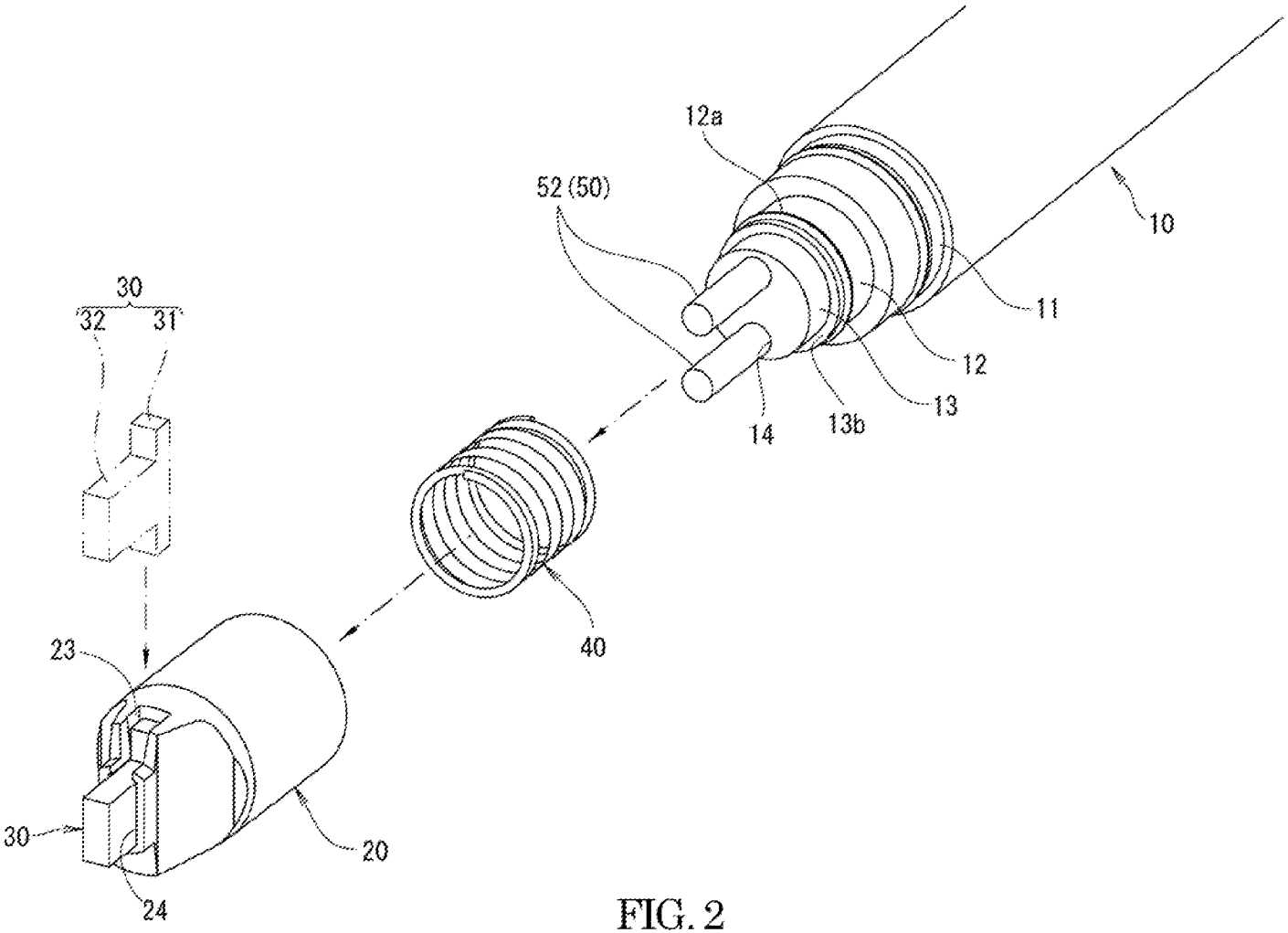
FIG. 2 is an exploded perspective view of features of the writing utensil.
Figure 3:
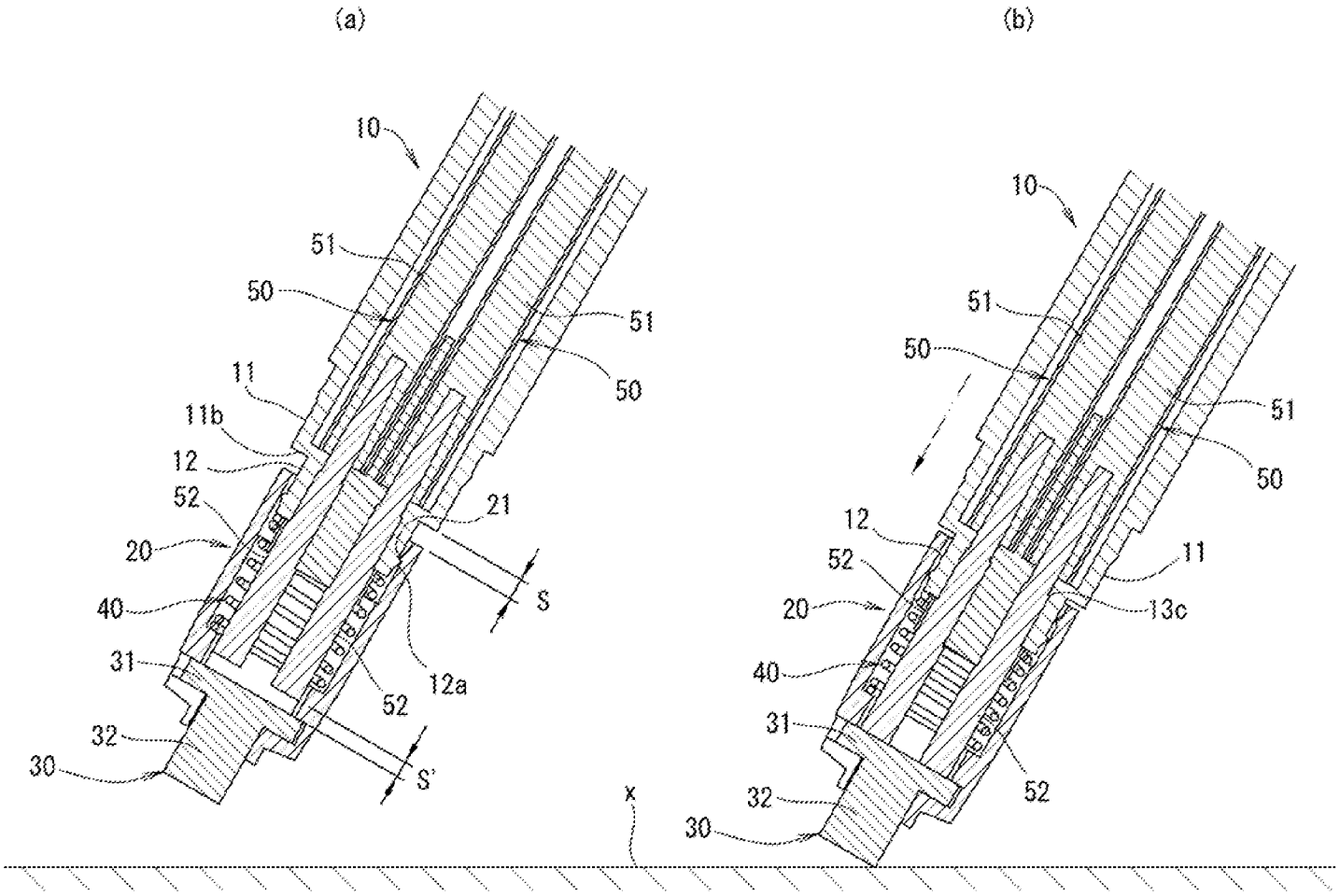
FIG. 3 at (a) and (b) is an enlarged longitudinal section view of features of the writing utensil in which FIG. 3 at (a) and (b) respectively shows states before and after a writing chip is pressed against a written face.

A first feature includes: a shaft tube; a writing chip that protrudes more toward the front than the shaft tube so as to discharge ink when the writing chip is pressed against a written face; and an ink supply part that supplies ink to the writing chip from a rear side, and the writing chip is at a separate position separated toward the front across a space with respect to the ink supply part and is moved due to a predetermined operation to a contact position where the writing chip comes into contact with the ink supply part from a front side (refer to FIG. 1 to FIG. 3).

In a second feature, a plurality of the ink supply parts that respectively supply inks of different types are provided on a rear side of the single writing chip (refer to FIG. 1 to FIG. 3).

As a third feature, an urging member that urges the writing chip toward the front with respect to the shaft tube is provided, the predetermined operation is an operation to press the writing chip against a written face, and the operation causes the writing chip to retreat against an urging force of the urging member and assume the contact position (refer to FIG. 3).

In a fourth feature, the urging member is a compression coil spring that is provided between the writing chip and the shaft tube and the ink supply part is passed through the compression coil spring (refer to FIG. 1 to FIG. 3).

As a fifth feature, the shaft tube is provided with a chip holding member so as to protrude toward the front from the shaft tube and to slide in a front and rear direction with respect to the shaft tube, and the writing chip is integrally provided on the chip holding member (refer to FIG. 1 to FIG. 3).

As a sixth feature, the writing chip and the ink supply part are fibers bundled bodies.

As a seventh feature, a chip holding member that holds the writing chip on a front end side of the shaft tube is provided, and the writing chip is fitted to the chip holding member from outside in a shaft tube radial direction (refer to FIG. 2).

As an eighth feature, the chip holding member is provided with a notch for inserting the writing chip from a side and a chip pass-through hole that causes a front end part of the writing chip fitted to the notch to protrude more toward the front than the chip holding member (refer to FIG. 2).

As a ninth feature, the writing chip integrally includes a base part that is positioned inside the chip holding member and a pen tip part of which a dimension in a radial direction is smaller than the base part and which protrudes toward the front, and the base part is fitted to the notch so as to be incapable of advancing and retreating and the pen tip part is passed through the chip pass-through hole (refer to FIG. 1 to FIG. 3).

A tenth feature is a producing method of a writing utensil, the producing method including a step of: fitting the writing chip to the chip holding member from outside in a shaft tube radial direction (refer to FIG. 2).

Specific Embodiment

Next, specific embodiments having the features described above will be described in detail based on the drawings.

In the present specification, a shaft tube axial direction refers to a direction in which a central line of a shaft tube extends and a shaft tube circumferential direction refers to a direction around a circumference of the shaft tube central line. In addition, "front" refers to a direction on one side of the shaft tube axial direction in which a writing chip protrudes and "rear" refers to a side of an opposite direction with respect to the one side. Furthermore, in the present specification, the shaft tube radial direction refers to a diameter direction of the shaft tube which is perpendicular to the central line of the shaft tube, outside in the shaft tube radial direction refers to a direction of separation from a center of the shaft tube along the shaft tube radial direction, and inside in the shaft tube radial direction refers to a direction of approach to the center of the shaft tube along the shaft tube radial direction.

A writing utensil A includes: a shaft tube 10; a chip holding member 20 which is provided so as to protrude toward the front from the shaft tube 10 and to slide in a front and rear direction with respect to the shaft tube 10; a writing chip 30 which is integrally provided on a front end side of the chip holding member 20 so as to discharge ink when pressed against a written face x; an urging member 40 which urges the chip holding member 20 toward the front with respect to the shaft tube 10; and a plurality of ink supply parts 50 which supply inks of different kinds to the single writing chip 30 from a rear side.

According to the writing utensil A, the writing chip 30 is at a separate position (refer to FIG. 3A) that is separated toward the front across a space with respect to the ink supply part 50 and moves toward the rear when a predetermined operation is performed to a contact position (refer to FIG. 3 at (b)) where the writing chip 30 comes into contact with the ink supply part 50 from a front side.

In this case, according to the illustrated example, the predetermined operation is an operation of pressing the writing chip 30 against the written face x.

The shaft tube 10 is a tubular member that is elongated in a front and rear direction. The shaft tube 10 is formed in an elongated cylindrical shape that contains the ink supply part 50, and integrally provided on a front end side of the shaft tube 10 are: a cap mounting part 11 for mounting a cap 70; a slide support part 12 that slidably supports the chip holding member 20 on a front side of the cap mounting part 11; and a relay core holding part 13 that holds a relay core 52 of the ink supply part 50 so as to protrude toward the front on a front side of the slide support part 12. In addition, a rear end opening of the shaft tube 10 is closed by a detachable tail plug 60.

While the shaft tube 10 according to the illustrated example is constituted of a single tubular body, as another example, a mode may be adopted in which a plurality of tubular bodies are connected to each other.

The cap mounting part 11 is an approximately cylindrical part of which a diameter has been reduced with respect to a rear-side cylindrical part and which is formed so as to be inserted into the cap 70.

An outer circumferential face of the cap mounting part 11 is provided with an annular projection 11*a* to be surmounted toward the rear and fitted by an engaging/disengaging projection 71 of the cap 70. The annular projection 11*a* has a conical longitudinal section and is continuous around an entire circumference of the cap mounting part 11. In the cap mounting part 11, a part on a front side of the cap mounting part 11 is a cylindrical surface without any irregularities.

The slide support part 12 is an approximately cylindrical part of which a diameter has been reduced with respect to the cap mounting part 11. An outer circumferential face of the slide support part 12 is provided with a retaining projection 12*a* for retaining the chip holding member 20. In the slide support part 12, a part on a front side of the retaining projection 12*a* and a part on a rear side of the retaining projection 12*a* are cylindrical surfaces without any irregularities.

The retaining projection 12*a* has a conical longitudinal section of which a rear side face is more steeply inclined than a front side face and is continuous around an entire circumference of the slide support part 12.

The relay core holding part 13 is an approximately cylindrical part of which a diameter has been reduced with respect to the slide support part 12.

An outer circumferential face of the relay core holding part 13 is inserted into the urging member 40 to function as a guide face of the urging member 40 which extends and contracts. In addition, a step part 13*b* that constitutes a boundary between the relay core holding part 13 and the slide support part 12 functions as a receiving face for receiving a rear end of the urging member 40.

The relay core holding part 13 is provided in plurality (in the illustrated example, two) across an interval in the radial direction with a relay core holding hole 14 into which the relay core 52 is penetratingly passed through along a front and rear direction and which nonretractably holds the relay core 52.

The relay core holding hole 14 is provided so as to extend into the slide support part 12 and a step part 13*c* of which a diameter is reduced toward the rear is provided at a midway position in a direction of extension of the relay core holding hole 14 so as to nonretractably hold the relay core 52.

The chip holding member 20 is formed in an approximately bottomed tubular shape in which a front end wall constitutes a bottom part and a rear end is opened to cover a tip side of the relay core 52, the slide support part 12, and the urging member 40 in a tubular manner and to fit the writing chip 30 to a front end side so as to prevent the writing chip 30 from advancing and retreating (refer to FIG. 1 and FIG. 3).

An inner circumference face on a rear end side of the chip holding member 20 is provided in plurality (in the present example, three at regular intervals) across intervals in the circumferential direction with a locking projection 21 to be locked by the retaining projection 12*a* of the slide support part 12.

Each locking projection 21 is formed in a conical longitudinal section of which a front side face is more steeply inclined than a rear side face. When the chip holding member 20 is assembled to the slide support part 12, the locking projection 21 surmounts the retaining projection 12*a* of the slide support part 12 toward the rear and positions itself on a rear side of the retaining projection 12*a*.

In addition, an inner circumference face on a front end side of the chip holding member 20 is provided with an annular step part 22 for receiving a front end of the urging member 40.

Furthermore, a circumferential wall on a front side of the step part 22 of the chip holding member 20 is provided with a notch 23 into which the writing chip 30 is to be inserted from a side, and a wall part on a frontmost end of the chip holding member 20 is provided with a chip pass-through hole 24 which causes the writing chip 30 to protrude toward the front.

The notch 23 and the chip pass-through hole 24 are communicated with each other in the shaft tube radial direction.

The chip pass-through hole 24 penetrates the frontmost end wall part of the chip holding member 20 in a front and rear direction.

The writing chip 30 is a fibers bundled body which is constituted of a large number of strands of synthetic fiber and which is integrally equipped with a base part 31 that is positioned inside the chip holding member 20 and a pen tip part 32 having a smaller diameter in the radial direction than the base part 31 and protruding toward the front and, according to the illustrated example, the writing chip 30 is formed as a laterally facing T-shaped chip (refer to FIGS. 1 and 2).

As shown in FIG. 2, the writing chip 30 is fitted to the notch 23 of the chip holding member 20 from outside in the shaft tube radial direction and causes the pen tip part 32 to be exposed toward the front and the base part 31 to be present inside the chip holding member 20.

In addition, in a state where no writing pressure is applied (refer to FIG. 3 at (a)), the writing chip 30 is held at a separate position that is separated toward the front across a space with respect to the ink supply part 50 so that ink is not supplied from the ink supply part 50.

Furthermore, in a state where writing pressure is applied (refer to FIG. 3 at (b)) by pressing the writing chip 30 against the written face x or the like, the writing chip 30 retreats relative to the shaft tube 10 and assumes a contact position where the writing chip 30 comes into contact with the relay core 52 of the ink supply part 50 from a front side.

As other examples of the writing chip 30, the writing chip 30 may have a pen tip shape that differs from the illustrated example such as a shell shape, a columnar shape, or a wedge shape.

The urging member 40 is a compression coil spring provided between the front side step part 22 of the chip holding member 20 and the front end step part 13*b* of the slide support part 12 in the shaft tube 10.

The urging member 40 annularly fits a rear end side thereof to the relay core holding part 13 to cover both relay cores 52, 52 in a tubular manner and urges the chip holding member 20 toward the front with respect to the shaft tube 10 to hold the separate position of the writing chip 30.

The ink supply part 50 is provided in plurality (in the illustrated example, two, side by side, in the shaft tube radial direction) around the central axis of the shaft tube 10. Each ink supply part 50 is equipped with an ink reservoir part 51 having an elongated columnar shape along the entire length of the shaft tube 10 and the relay core 52 provided so as to extend toward the front from a front end of the ink reservoir part 51.

The ink reservoir part 51 has a large number of strands of synthetic fiber housed in a thin cylindrical body which is made of synthetic resin and of which an interior is impregnated with ink and the ink reservoir part 51 may also be referred to as wadding. Among the two ink reservoir parts 51, one and the other are respectively impregnated with ink of different colors.

Each ink reservoir part 51 is held in the shaft tube 10 so as to be positioned between the step part 10*a* at the rear end of the slide support part 12 and a rear end face of the tail plug 60 so that the ink reservoir part 51 hardly moves.

Each relay core 52 is a fibers bundled body constituted of a large number of strands of synthetic fiber and is formed in an elongated columnar shape of which a rear end side is tapered.

The rear end side of the relay core 52 is pressed into the ink reservoir part 51 from a front side. In addition, a midway part in a longitudinal direction of the relay core 52 is nonretractably held by the relay core holding hole 14.

Furthermore, a front end side of the relay core 52 protrudes toward the front from the relay core holding part 13 and is extended toward the front inside the urging member 40, and a frontmost end part thereof is arranged on a front side of the front end of the urging member 40.

Among the writing chip 30, the ink reservoir part 51, and the relay core 52, porosity (voidage) increases in a sequence of the writing chip 30, the relay core 52, and the ink reservoir part 51.

According to a preferable example of the present embodiment, the porosity of the writing chip 30 is approximately 65%, the porosity of the relay core 52 is approximately 76%, and the porosity of the ink reservoir part 51 is 90%.

In addition, the tail plug 60 is formed in a bottomed tubular shape with its rear end acting as a bottom wall part and is detachably and hermetically inserted with pressure into a rear end side of the shaft tube 10. The tail plug 60 is detached when exchanging the ink supply part 50 or the like.

The cap 70 is formed in a bottomed tubular shape with its front end acting as a bottom wall part and is detachably and hermetically fitted to the cap mounting part 11 on the front end side of the shaft tube 10.

An inner circumference face on a rear end side of the cap 70 has the engaging/disengaging projection 71 that surmounts the annular projection 11*a* of the cap mounting part 11 toward the rear to be locked by the annular projection 11*a* and the annular projection 72 that comes into close contact with the outer circumferential face of the cap mounting part 11 around an entire circumference thereof on a front side of the engaging/disengaging projection 71. In addition, a clip is provided on an outer circumference face.

Next, a characteristic operational effect of the writing utensil A configured as described above will be described in detail.

First, in an initial state in which writing pressure is not applied, the writing chip 30 is at the separate position where the writing chip 30 does not come into contact with the ink supply part 50.

More specifically, at the separate position, as shown in FIG. 3 at (a), a gap s is secured between the rear end face of the chip holding member 20 and the step part 11*b* on the front end side of the shaft tube 10 and a space of a gap s' is secured between the rear end face of the writing chip 30 and the front end face of the plurality of ink supply parts 50 (more precisely, the relay core 52).

Therefore, at the separate position, while ink flows from the ink reservoir part 51 to the relay core 52 due to capillary force, the ink never reaches the writing chip 30.

Next, when the front end side of the writing chip 30 is pressed against a written face x such as a sheet of paper (in other words, when writing pressure is applied to the writing chip 30), the writing chip 30 retreats due to the writing pressure and assumes the contact position where the writing chip 30 comes into contact with the ink supply part 50 from a front side.

More specifically, when writing pressure is applied to the writing chip 30, the chip holding member 20 retreats against an urging force of the urging member 40, the gap s narrows, and the rear end face of the writing chip 30 is brought into pressure contact with the front end part of the plurality of ink supply parts 50, 50.

Therefore, at the contact position, ink inside the plurality of ink supply parts 50 flows from the ink reservoir part 51 to the relay core 52 due to capillary force and further flows to the single writing chip 30 where the ink is discharged from the front end of the writing chip 30 to be applied to the written face x.

An applied writing line becomes a gradational writing line that is constituted of inks of a plurality of colors or a writing line of a color created when inks of a plurality of colors are mixed with each other.

Subsequently, when the writing chip 30 separates from the written face x, the writing chip 30 moves forward to the separate position described above due to an urging force of the urging member 40. For this reason, ink stops flowing from the relay core 52 to the writing chip 30.

Therefore, according to the writing utensil A, ink of the ink supply part 50 can be supplied to the writing chip 30 only in a writing state in which writing pressure is applied.

As a result, a situation where ink is excessively supplied to the writing chip 30 and dripping of ink occurs can be prevented.

In addition, even when a state where the cap 70 has been removed and writing is not performed continues for a long time, since a flow of ink between the relay core 52 and the writing chip 30 is prevented by the gap s, a situation where an amount of stored ink of the ink supply part 50 decreases due to volatilization of ink from the writing chip 30 can be prevented.

Furthermore, even when a state where no writing pressure is applied continues for a long time, a situation where ink of any of the ink supply parts 50 flows to another ink supply part 50 via the writing chip 30 can be prevented. In other words, although there is a risk that ink of one of the ink supply parts 50 passes through the writing chip 30 and is routed in an approximate U-shape to another ink supply part 50 when a configuration in which the gap s' is always absent according to the illustrated example is adopted, with the writing utensil A according to the present embodiment, since a flow path between the writing chip 30 and the ink supply parts 50 can be severed when the writing utensil A is not in use, the routing described above can be prevented and, by extension, a writing line created by the writing utensil A can be prevented from becoming an unintended writing line (for example, a writing line constituted of only one ink).

Modifications

While the ink supply part 50 is provided in plurality with respect to the single writing chip 30 as a particularly preferable example in the embodiment described above, as another example, a mode can be adopted in which a single ink supply part 50 is provided with respect to the single writing chip 30.

In addition, while ink of a different type is respectively stored in the plurality of ink supply parts 50 as a particularly preferable example in the embodiment described above, as another example, a mode can be adopted in which ink of a same type is stored in the plurality of ink supply parts 50.

Furthermore, while a compression coil spring is used as the urging member 40 as a particularly preferable example in the embodiment described above, as another example, the urging member 40 can also be configured as an elastic body such as rubber.

In addition, while the writing chip 30 is indirectly urged toward the front via the chip holding member 20 as a particularly preferable example in the embodiment described above, as another example that is not illustrated, a configuration can be adopted in which the chip holding member 20 is omitted, the writing chip 30 is engaged with the shaft tube 10 so as to be slidable toward the front and rear, and the writing chip 30 is directly urged toward the front by the urging member 40.

Furthermore, while an operation of pressing the writing chip 30 against the written face x is adopted as the predetermined operation for moving the writing chip 30 from the separate position to the contact position, as another example, a configuration can be adopted in which an operation other than that of the mode described above such as a sliding operation or a rotating operation of an operating part (not illustrated) is performed as the predetermined operation and the operation causes the writing chip 30 at the separate position to move to the contact position.

It should be noted that the present invention is not limited to the embodiment described above and various modifications can be made without departing from the gist of the present invention.

REFERENCE SIGNS LIST

10 Shaft tube
20 Chip holding member
30 Writing chip
40 Urging member
50 Ink supply part
51 Ink reservoir part
52 Relay core
A Writing utensil

What is claimed is:

1. A writing utensil, comprising:
a shaft tube;
a writing chip that protrudes more toward a front than the shaft tube so as to discharge ink when the writing chip is pressed against a written face; and
an ink supply part that supplies ink to the writing chip from a rear side, wherein
the writing chip is at a separate position separated toward the front across a space with respect to the ink supply part and is configured to be moved due to a predetermined operation to a contact position where the writing chip comes into contact with the ink supply part from a front side.

2. The writing utensil according to claim 1, wherein a plurality of the ink supply parts that respectively supply inks of different types are provided on a rear side of the single writing chip.

3. The writing utensil according to claim 1, wherein a spring or elastic structure that urges the writing chip toward the front with respect to the shaft tube is provided,
the predetermined operation is an operation to press the writing chip against the written face, and the operation causes the writing chip to retreat against an urging force of the spring or elastic structure and assume the contact position.

4. The writing utensil according to claim 3, wherein the spring or elastic structure is a compression coil spring that is provided between the writing chip and the shaft tube and the ink supply part is passed through the compression coil spring.

5. The writing utensil according to claim 3, wherein the writing chip and the ink supply part are fibers bundled bodies.

6. The writing utensil according to claim 1, wherein the shaft tube is provided with a chip holder so as to protrude toward the front from the shaft tube and to slide in a front and rear direction with respect to the shaft tube, and the writing chip is integrally provided on the chip holder.

7. The writing utensil according to claim 1, comprising a chip holder that holds the writing chip on a front end side of the shaft tube, wherein
the writing chip is fitted to the chip holder from outside in a shaft tube radial direction.

8. The writing utensil according to claim 7, wherein the chip holder is provided with a notch to insert the writing chip from a side and a chip pass-through hole that causes a front end part of the writing chip fitted to the notch to protrude more toward the front than the chip holder.

9. The writing utensil according to claim 8, wherein the writing chip integrally includes a base part that is positioned inside the chip holder and a pen tip part of which a dimension in a radial direction is smaller than the base part and which protrudes toward the front, and the base part is fitted to the notch so as to be incapable of advancing and retreating and the pen tip part is passed through the chip pass-through hole.

10. A producing method of the writing utensil according to claim 7, the producing method including fitting the writing chip to the chip holder from outside in a shaft tube radial direction.

11. A writing utensil, comprising:

a shaft tube;

a writing chip that protrudes more toward a front than the shaft tube so as to discharge ink when the writing chip is pressed against a written face; and an ink supply part that supplies ink to the writing chip from a rear side, wherein the writing chip is at a separate position separated toward the front across a space with respect to the ink supply part and is configured to be moved due to a predetermined operation to a contact position where the writing chip comes into contact with the ink supply part from a front side, wherein the writing chip and the ink supply part are fibers bundled bodies.

* * * * *